United States Patent [19]

Lefebvre

[11] Patent Number: 4,803,321

[45] Date of Patent: Feb. 7, 1989

[54] AXIAL LOAD RESISTANT KEY SWITCH

[75] Inventor: Jean-Claude Lefebvre, Dole, France

[73] Assignee: ITT Composants Et Instruments, Bagneux, France

[21] Appl. No.: 121,206

[22] Filed: Nov. 16, 1987

[51] Int. Cl.[4] ..... H01H 1/14; H01H 9/02

[52] U.S. Cl. ..... 200/517; 200/294; 200/406

[58] Field of Search ..... 200/159 B, 294, 293, 200/340, 159 R, 67 D, 67 DB

[56] References Cited

U.S. PATENT DOCUMENTS

| | | | |
|---|---|---|---|
| 3,777,090 | 12/1973 | Muller | 200/159 B |
| 4,352,963 | 10/1982 | De Filippis et al. | 200/159 B X |
| 4,418,257 | 11/1983 | Muller et al. | 200/159 B |
| 4,484,042 | 11/1984 | Matsui | 200/67 DB |

*Primary Examiner*—Renee S. Luebke
*Attorney, Agent, or Firm*—Thomas L. Peterson

[57] ABSTRACT

A short travel key switch comprising an electrically insulating base having a bottom and a cylindrical lateral wall defining a cavity closed by a cap. A central contact and a lateral contact are mounted on the bottom. The periphery of a switching element received in the cavity is in electrical contact with the lateral contact. The element is elastically yieldable to establish an electrical connection between the two contacts in response to an axial load exerted on its convex face by the facing portion of an actuator. The central contact is mounted flush with a plane central portion of the bottom. The facing portion of the actuator which engages the central contact is flat.

6 Claims, 1 Drawing Sheet

AXIAL LOAD RESISTANT KEY SWITCH

BACKGROUND OF THE INVENTION

The present invention relates generally to a key switch, or a push button switch, and more particularly to a miniature electrical switch having an inoperative condition in which the circuit controlled by the switch is open, and an operative condition in which the push button is depressed and the circuit is closed.

The invention more particularly relates to a short travel key switch of the type comprising an electrically insulating base having a bottom and a cylindrical lateral wall defining a cavity closed by a cap, a central contact and a lateral contact both arranged on said bottom, a dome-shaped switching element received in said cavity the periphery of which is in electrical contact with the lateral contact, and which is elastically yieldable to establish an electrical connection between the two contacts in response to an axial load exerted on its convex face by the facing portion of the head of an actuator disposed in the cavity and having a stem passing through a central hole of the cap.

The invention is applicable, for example, to electronic apparatus such as motor car radio sets wherein such switches are grouped on a main printed circuit board to form a control keyboard.

Previously known switches of this type, such as the one represented in FIG. 1, have the major drawback to be insufficiently resistant to the axial load exerted on the stem of the actuator. This results in unacceptable deformation and damage of the main components of the switch. More particularly, the prior art switch cannot resist the very high axial load, on the order of 50 lbs. or greater which is applied thereon several times during certification tests such as those required by the car manufacturers.

An object of the present invention is to obviate these disadvantages by providing a switch which is highly axial load resistant.

SUMMARY OF THE INVENTION

According to one aspect of the invention, there is provided a short travel key switch of the type described above in which the central contact is mounted flush with a plane central portion of the bottom of the insulating base and the facing portion of the actuator head which engages the central contact is a flat face.

According to another aspect of the invention, the lateral contact of the switch is a substantially semi-annular metallic element, the upper face of which projects slightly above the central plane portion of the base bottom. The bottom is provided with a substantially semi-annular shoulder, on which bears a portion of the periphery of the switching element. The upper face of the shoulder is essentially coplanar with the upper surface of the lateral contact.

Other aspects of the invention will become apparent from the following description taken in connection with the accompanying drawing.

DESCRIPTION OF THE PREFERRED EMBODIMENT

Figure 1:
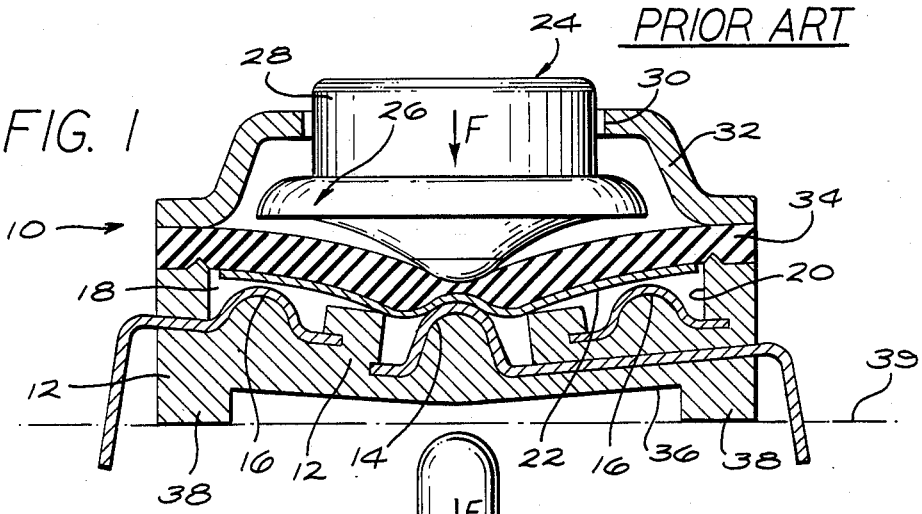
PRIOR ART FIG. 1
FIG. 1 is an axial sectional view of a switch known from the state of the art in an operative condition and under a high axial force.

A prior art short travel key switch 10, such as the one shown in FIG. 1, comprises a base 12 of electrically insulating plastic material. The base 12 carries at least two fixed contacts, a central contact 14 and a lateral contact 16. Both contacts are arranged on the bottom of a cavity 18 defined by a cylindrical lateral inner wall 20.

The lateral fixed contact 16 may be an annular, or semi-annular metallic element on which bears the peripheral portion of a deformable metallic switching element 22.

The switching element 22 is, in its non-deformed position, i.e. when the switch is in its nonoperative condition, a dome shaped element received in the cavity 18 and having its convex face turned upwardly.

The dome-shaped element 22 is elastically yieldable, or deformable, in response to an axial loading force F exerted upon its convex face in order to establish an electrical connection between the two fixed contacts 14 and 16.

The axial force F is exerted by means of an actuator 24 which comprises a head 26 and a stem 28 which protrudes toward the exterior of the cavity 18 through a centrally located hole 30 in a top cover plate, or cap, 32.

Figure 2:
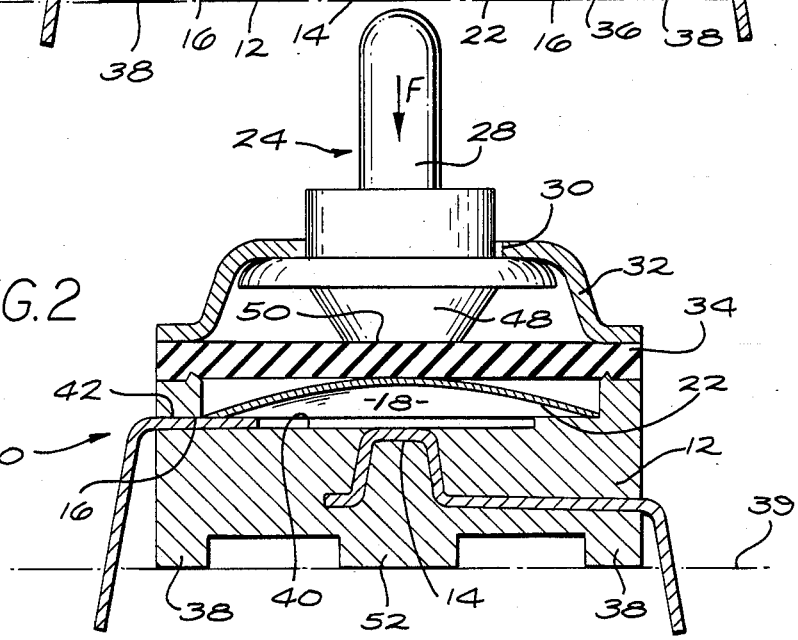
FIG. 2 is an axial sectional view of a switch according to the invention in an inoperative condition.
Figure 3:
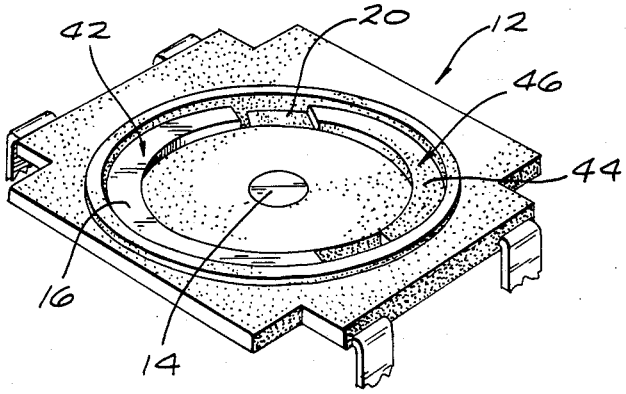
FIG. 3 is a perspective view of the base element of the switch of FIG. 2.

In case of a sealed switch, such as the ones shown in FIGS. 1 and 2, the cap 32 closes the cavity 18 with a sealing rubber membrane 34 interposed therebetween.

In the prior art switch of FIG. 1, the head 26 is provided with a lower end having a spherical tip 36 facing the membrane 34 and the switching element 22.

As it is clearly apparent from FIG. 1, the application of an excesive axial load F on the actuator 24 results in undesired deformations of the switching element 22 and of the lower face 36 of the base 12. Four lateral feet 38 extending downwardly from the base bear on the upper face 39 of a printed circuit board shown in phantom lines. Several application of an excessive load F generally result in a permanent deterioration of the various components of the switch 10.

According to the present invention, the bottom 40 of the cavity 18 is a plane central portion of the base 12. The central contact 14 is mounted flush with the bottom 40 and appears like a disc-shaped contact embedded in the base 12.

The lateral contact 16 is a semi-annular metallic contact arranged on the flat bottom 40 so that, due to its thickness, its upper face projects slightly above the bottom 40.

Facing the lateral contact 16 is a complementary semi-annular shoulder 44 on which bears the peripheral portion of the dome-shaped switching element 22. The height of the shoulder 44 is chosen so that its upper face 46 is coplanar with the upper face 42 of the lateral contact 16. The shoulder 44 is integral with the base 12.

According to the invention, the lower part 48 of the head 26 of the actuator 28 is provided with a flat horizontal surface 50 facing the convex face of the switching element 22.

It can be easily understood that, in case of an excessive axial load, the cooperation of the flat surface 50 with the plane bottom 40 prevents any damage of the switching element 22.

In order to avoid any deformation of the central portion of the base 12, the latter is provided with a central foot 52 coaxial with the central contact 14 and the stem 28 of the actuator.

Although only one embodiment of the invention has been disclosed herein for purposes of illustration, it will be understood that various changes can be made in the form, details, arrangement and proportions of the various parts in such embodiment without departing from the spirit and scope of the invention as defined by the appended claims.

What is claimed is:

1. In a key switch comprising an electrically insulating base having a bottom and an upstanding lateral wall defining a cavity closed by a cap, a central contact and a lateral contact mounted on said bottom, a dome-shaped switching element mounted in said cavity over said contacts, the periphery of said element being in electrical contact with said lateral contact, said element being elastically yieldable to establish an electrical connection between said contacts in response to an axial load exerted on the convex face of said element, an actuator for exerting said axial load, said actuator having a facing portion disposed over said element and a stem passing through a central hole in said cap, the improvement which comprises:

said bottom of said base having a plane central portion facing said switching element;

said central contact comprising an upstanding projection having an essentially flat contacting surface facing said switching element, said projection being embedded in said base with said flat contacting surface being flush with said plane central portion; and said facing portion of said actuator being a flat face generally parallel to said flat contacting surface.

2. A key switch as set forth in claim 1 wherein:

said flat face is substantially perpendicular to the axis of said stem.

3. A key switch as set forth in claim 1 wherein:

said lateral contact is a substantially semi-annular metallic element mounted on one side of said plane central portion, said element having a flat upper face projecting slightly above said plane central portion;

said bottom is provided with a substantially semi-annular shoulder generally opposite to said lateral contact;

said shoulder has an upper face essentially coplanar with the upper surface of said lateral contact; and the periphery of said switching element is supported by said lateral contact and said upper face of said shoulder.

4. A key switch as set forth in claim 1 wherein:

said base is provided with several peripheral feet protruding from its lower face and a central foot coaxial with said central contact.

5. A key switch comprising:

an electrically insulating base having a bottom provided with a plane central portion;

a central contact and a lateral contact mounted on said bottom;

said central contact comprising an upstanding projection having an essentially flat contacting surface, said projection being embedded in said base with said flat contacting surface being flush with said plane central portion;

a dome-shaped switching element mounted over said contacts, the periphery of said element being in electrical contact with said lateral contact;

said element being elastically yieldable to establish an electrical connection between said contacts in response to an axial load exerted on the convex face of said element; and an actuator for exerting said axial load, said actuator having a flat face disposed over said element above said central contact and being generally parallel to said flat contacting surface.

6. A key switch as set forth in claim 5 wherein:

said lateral contact is a substantially semi-annular metallic element mounted on one side of said plane central portion, said element having an upper face projecting slightly above said plane central portion;

said bottom is provided with a substantially semi-annular shoulder generally opposite to said lateral contact;

said shoulder has an upper face essentially coplanar with the upper surface of said lateral contact; and said periphery of said switching element is supported by said lateral contact and said upper face of said shoulder.

* * * * *